United States Patent [19]

Stay

[11] Patent Number: 4,773,474

[45] Date of Patent: Sep. 27, 1988

[54] SNAP ON FILLERNECK ASSEMBLY FOR RADIATORS

[75] Inventor: Kevin E. Stay, Greenfield, Wis.

[73] Assignee: Modine Manufacturing Company, Racine, Wis.

[21] Appl. No.: 84,979

[22] Filed: Aug. 12, 1987

[51] Int. Cl.[4] ..... F28F 7/00

[52] U.S. Cl. ..... 165/76; 165/178; 220/203; 220/DIG. 32; 285/319

[58] Field of Search ..... 220/DIG. 32, 203, 303, 220/361, 367; 165/76, 104.32, 178; 285/319, 330, 921; 141/382, 346; 137/798

[56] References Cited

U.S. PATENT DOCUMENTS

| | | | |
|---|---|---|---|
| 1,039,354 | 9/1912 | Bonadio | 285/319 |
| 2,819,001 | 1/1958 | Pottle | 222/566 |
| 2,920,799 | 1/1960 | Binder | 222/541 |
| 3,115,284 | 12/1963 | Ankney | 222/566 |
| 3,154,283 | 10/1964 | Spinnato | 248/221 |
| 3,243,206 | 3/1966 | Samer | 285/162 |
| 3,568,977 | 3/1971 | Nelson | 251/148 |
| 3,828,418 | 8/1974 | Laurizio | 29/451 |
| 3,977,576 | 8/1976 | Amabili | 222/402.1 |
| 4,462,620 | 7/1984 | Bambenek et al. | 285/162 |

*Primary Examiner*—Samuel Scott
*Assistant Examiner*—Noah Kamen
*Attorney, Agent, or Firm*—Wood, Dalton, Phillips, Mason & Rowe

[57] ABSTRACT

A snap on fillerneck for a tank 52, 76 on a heat exchanger includes a hollow body 10 having an interior sealing surface 20 intermediate its ends 12, 14 which is adapted to be engaged by a seal 22 on a pressure cap 24 and which faces axially toward one end 12 of the body 10. An exterior flange 28 is located on the end 12 of the body 10 and has a pressure cap retaining surfaces 30, 32 for retaining the pressure cap 24 thereon. Resilient fingers 36 extend from the other end 14 of the body 10 and have integral, generally radially movable retaining surfaces 38 for retaining abutment with an end 58, 58' in a mounting element 50, 50'. The body 10 includes an exterior sealing surface 44 intermediate the ends 12, 14 thereof for cooperation with a seal 46 to seal the interface of the body 10 and the mounting elements 50, 50'.

15 Claims, 1 Drawing Sheet

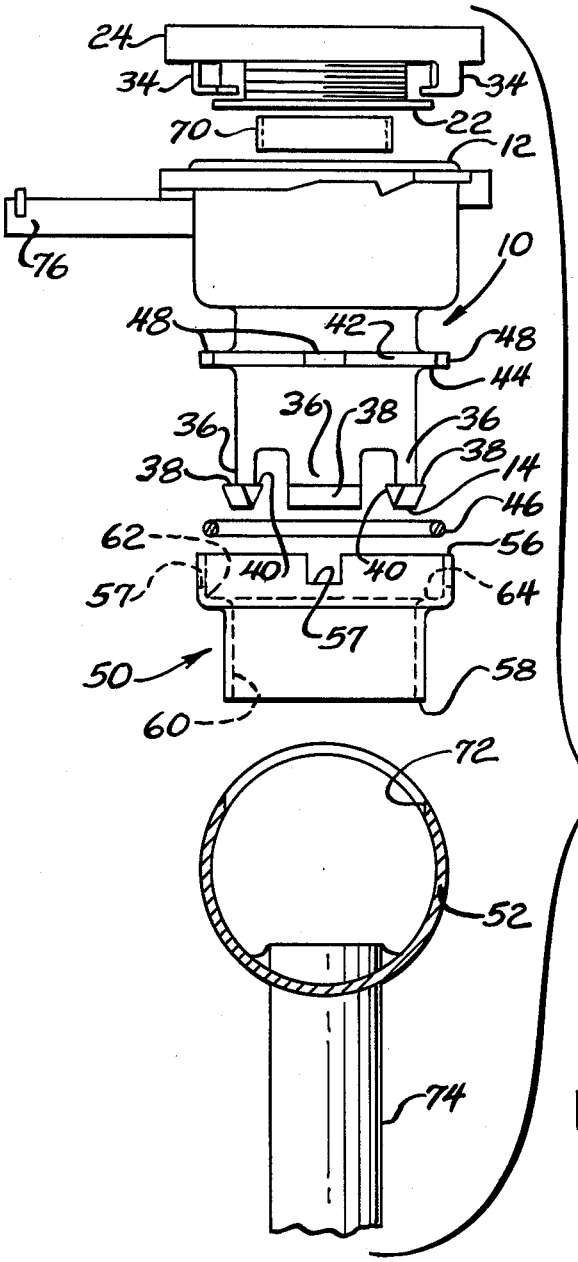
FIG. 1
FIG. 2
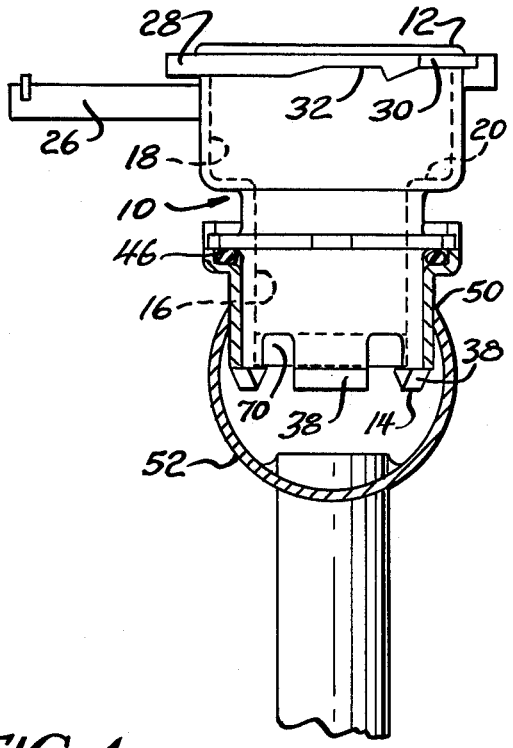
FIG. 3
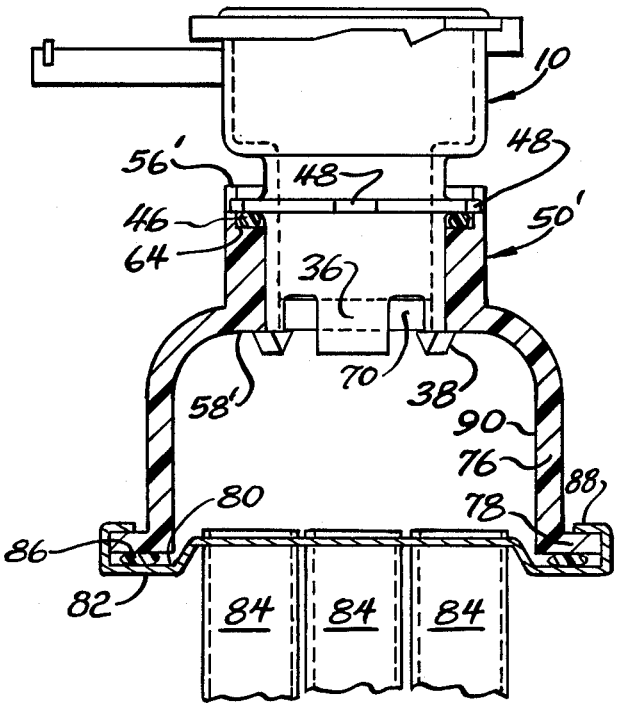

SNAP ON FILLERNECK ASSEMBLY FOR RADIATORS

FIELD OF THE INVENTION

This invention relates to heat exchangers as, for example, vehicular radiators, and more specifically, to fillerneck assemblies for such heat exchangers.

BACKGROUND OF THE INVENTION

Increasing concern for energy efficiency in vehicles over the last decade or so has resulted in a variety of attempts to, amongst other things, reduce the weight of a vehicle to allow the same to be propelled by a smaller engine that will consume less fuel. Virtually all parts of a vehicle have been subject to consideration for weight reduction and the heat exchanger for engine coolant or so-called radiator is no exception.

In the case of weight reduction of radiators, the focus has been on the use of less dense materials in construction the radiator or the appurtenances thereto. Consequently, many radiators now in use today utilize aluminum components in preference to a copper brass construction because of the lesser weight of an otherwise identical aluminum configuration. Similarly, metal tanks and/or combination tanks/headers, have been replaced with molded plastic tanks which have a lesser weight than a corresponding metal tank.

These changes have indeed achieved weight reduction but at the same time have generated new problems unique to these constructions.

For example, in considering an aluminum radiator, the various components including tubes, fins, headers and headers/tanks, fillernecks, etc. are typically brazed together. Brazing, of course, requires subjection of the assembly to an elevated temperature and the high temperature can result in partial or entire annealing of the aluminum metal. While this may not present a problem in many parts of an aluminum radiator, it can cause difficulties in the fillerneck. The annealed material at the fillerneck is, of course, softer than the material would be if not annealed and may be so soft as to be easily damaged during handling in the manufacturing process or in the process of assembling the radiator to a vehicle. Furthermore, the same may be damaged if subjected to rough treatment in applying or removing a pressure cap from the fillerneck after the radiator has been installed in a vehicle.

In the case of the use of plastic tanks, the same are typically molded and formed by an injection molding process. Frequently, each different model of radiator core has its own unique form of tank to be applied thereto to form a completed radiator. This in turn means that tooling, including complicated molds, must be provided for each different configuration of tank.

In a typical tank, the most expensive part to tool for is the fillerneck which is integral with the tank. Thus, plastic tanks, though providing a weight savings, are more expensive than desired because of the complexity of tooling and the fact that a great number of differing tools are required because of the large variety of differing models of tanks.

The present invention is intended to overcome one or more of the above problems.

SUMMARY OF THE INVENTION

The principal object of the invention is to provide a new and improved fillerneck assembly. More specifically, it is an object of the invention to provide a fillerneck assembly that may be advantageously used in a connection with aluminum radiators to eliminate strength problems heretofore encountered in such assemblies and/or with molded plastic tanks to reduce the cost of tooling for such tanks.

An exemplary embodiment of the invention achieves the foregoing objects in a fillerneck construction including a hollow body having an interior sealing surface intermediate its ends, the sealing surface is adapted to be engaged by a seal in a pressure cap and faces axially toward one end of the body. An exterior flange is disposed on that end of the body and has a pressure cap retaining surface thereon for retaining a pressure cap on the one end with the pressure cap seal engaging the sealing surface. Resilient fingers extend from the other end of the body and have integral, generally radially movable retaining surfaces for retaining abutment with an end of an opening in a mounting element for the fillerneck and an exterior sealing surface is disposed on the body intermediate the ends thereof for cooperation with a seal to seal the interface of the body and the mounting element.

As a consequence of this construction, in the case of an aluminum radiator or the like, after the radiator has been brazed, the fillerneck may be applied thereto in a separate mounting operation by snap fitting the same to a mounting element on the radiator. Because the fillerneck is not subject to the heat of the brazing operation, it will have substantial strength and will not be subject to being easily damaged.

In the case of a plastic header or the like, the same may be formed with tooling to merely provide an opening in the tank, and all models of plastic tanks may be similarly tooled. One fillerneck assembly can be made as a universal fillerneck assembly and applied to all the models of tanks thereby substantially reducing tooling costs for each such tank.

In a preferred embodiment, the fillerneck body, between the interior sealing surface and the one end includes a vent port.

The invention contemplates that the exterior sealing surface be an axially facing surface facing oppositely of the interior sealing surface. Preferably, the exterior sealing surface is defined by the side of a peripheral flange extending about the body intermediate the ends thereof. The flange further carries antirotation means for cooperation with mating antirotation means on the mounting element.

In a highly preferred embodiment, the antirotation means comprise radially directed formations on the flange. Typically, such means may comprise projections and/or slots for receiving the projections.

The invention contemplates that the fillerneck be in combination with the mounting element and in such a case, the mounting element may comprise a hollow coupling having a first open end for receipt of the body and an opposite open end for retaining engagement with the fingers. The hollow coupling further includes an interior sealing surface facing the exterior sealing surface of the body and a seal is disposed between such sealing surfaces in sealing engagement therewith.

According to one embodiment of the invention, the coupling may be a separate element bonded to a tank while according to another embodiment of the invention, the coupling may be integrally formed with the tank.

Other objects and advantages will become apparent from the following specification taken in connection with the accompanying drawings.

DESCRIPTION OF THE DRAWINGS

FIG. 1 is an exploded view of a fillerneck assembly made according to the invention along with a pressure cap and part of a heat exchanger including a combination header-tank;

FIG. 2 shows the components of FIG. 1, less the pressure cap, in assembled relation; and FIG. 3 illustrates the fillerneck assembly of the invention applied to a molded plastic tank.

DESCRIPTION OF THE PREFERRED EMBODIMENTS

An exemplary embodiment of a fillerneck assembly made according to the invention is illustrated in FIGS. 1 and 2 and is seen to include an elongated, hollow body, generally designated 10. Typically, the body 10 will be formed of a plastic as, for example, a nylon, glass fiber reinforced plastic. The body 10 has a relatively larger open end 12 and a relatively smaller open end 14. Within the body 10 a reduced diameter passage 16 extends from the end 14 toward an enlarged diameter passage 18 which extends to the end 12. An axially facing shoulder 20 within the body 10 interconnects the passages 16 and 18 and acts as an interior sealing surface within the body for sealing engagement with the seal element 22 (FIG. 1) on a conventional pressure cap 24.

Intermediate the shoulder 20 and the end 12, the body 10 includes a generally radially extending, integral conduit 26 which serves as a vent conduit in a conventional fashion. That is to say, the conduit 26 may be connected to a hose which in turn is open to either atmosphere or to a reservoir, depending upon the particular cooling system utilized. The conduit 26 is, of course, in fluid communication with the interior of the body 10 and provides a means for passage of coolant in the event of an overpressure situation within the heat exchanger with which the fillerneck is utilized. In addition, if connected to a reservoir, the conduit 26 provides a means of ingress of fresh coolant into the system.

The end 12 of the body 10 is provided with a peripheral flange 28 which is notched as at 30 and at 32 on opposite sides of the body 10 to provide retaining means for retaining tabs 34 on the pressure cap 24 in a conventional fashion.

The end 14 is defined by a plurality of axially extending, radially movable, resilient fingers 36. Each of the fingers 36 terminates in a radially outwardly directed hook 38. In addition, two or more of the fingers 36 have a radially inward directed, interior ledge 40 for purposes to be seen.

Intermediate the ends 12 and 14, the body 10 is provided with a peripheral flange 42. One side 44 of the flange 42, which faces away from the interior shoulder 24 and axially toward the end 14, serves as an exterior sealing surface for engagement with an O-ring seal or gasket 46 as will be seen. In addition, at equally angularly spaced locations about the flange 42, the same is provided with radially extending projections 48 which serve as part of an antirotation means.

The assembly may also include a coupling such as that generally designated 50 in FIG. 1. The coupling 50 may be formed of any suitable material and may be integral with or separate from the tank, or header/tank to which it is ultimately attached. In the embodiment of FIGS. 1 and 2, the coupling 50 is separate from a combination header/tank 52 to which it is ultimately attached as shown in FIG. 2 by bonding such as brazing at a location 54 and typically will be formed of metal such as aluminum. The coupling 50 includes an enlarged end 56 which receives the relatively smaller end 14 of the body 10. The end 56 has equally angularly spaced recesses 57 which are alignable with and receive the projections 48 on the flange 42. They thus prevent relative rotation between the body 10 and the coupling 50. The coupling 50 also includes a reduced end 58. The coupling 50 further includes a small diameter passage 60 connected to a large diameter opening 62 adjacent the end 56 by an axially facing shoulder 64. The diameter of the reduced diameter section 60 is approximately equal to that of the end 14 of the body 10 disregarding the hooks 38 and as a consequence, when the body 10 is inserted into the coupling 50 as illustrated in FIG. 2, the fingers 36 will first be resiliently deflected radially inwardly and then, upon reaching the end 58 of the coupling, will snap outwardly to lodge the hooks 38 under the end 58 as seen in FIG. 2.

The arrangement is also such that when so assembled, the O-ring seal 46 will be placed under compression and thereby in sealing engagement with the surface 44 of the flange 42 as well as the shoulder 64 to thereby seal the interface between the body 10 and the coupling 50.

In this regard, the length of the coupling 50 from the end 58 to the shoulder 64 provides substantial column strength, eliminating the possibility that the hooks 38 could deform part of the structure which would result in the loss of the seal at the O-ring 46. Sources of force for such deformation may be the spring force applied to the flange side 44 by the O-ring 46 when the latter is compressed and internal normal operating pressures.

To prevent radially inward movement of the fingers 36 that would allow the hooks 38 to become disengaged with the end 58 of the coupling 50, a removable lock ring 70 having an outer diameter approximately equal to the inner diameter of the end 14 of the body 10 may be inserted into the body 10 and into engagement with the ledges 40 on the interior of the fingers 36. The lock ring 70 thus blocks radially inward movement of the fingers 36 while the ledges 40 serve to retain the lock ring 70 in place but can also be removed through the passages 16, 18 to allow the body to be disassembled from the coupling 50.

Prior to the above assembly of the body 10 to the coupling 50, the latter will have been placed within an opening such as the opening 72 in a tank or, as shown in FIG. 1, the combination header/tank typically found at one end of a radiator having a plurality of oval, coolant carrying tubes 74 arranged in a conventional fashion. A bonding process such as brazing will then be employed where the components are metal. However, if plastic parts are used, other processes may be employed. For example, the coupling 50 may be adhesively bonded to the tank or it may be solvent welded thereto. Alternatively, various plastic welding techniques may be utilized.

Alternatively, and as illustrated in FIG. 3, the coupling, there generally designated 50', may be integrally formed on a plastic tank 76. The plastic tank 76 has a peripheral flange 78 received in a peripheral groove 80 in a metal header plate 82 also receiving the ends of coolant carrying tubes 84. A compressed seal 86 is disposed between the flange 78 and the groove 82 and the periphery 88 of the header plate 82 is bent over the flange 78 for retaining purposes.

In this case, a part 58' of the interior wall 90 of the plastic tank 76 serves as the counterpart of the end 58 of the separate coupling 50. The spacing between the part 58' of the interior wall 90 and a shoulder 64' corresponding to the shoulder 64 provides desirable column strength as noted earlier.

To prevent relative rotation between the body 10 and the tank 76, the integral coupling 50', at its enlarged end 56' is provided with axially opening recesses 57' for receipt of the projections 48.

From the foregoing, it will be appreciated that a fillerneck assembly made according to the invention minimizes the possibility of damage to the fillerneck of a vehicular radiator or the like during manufacture, during assembly to the vehicle, or even during subsequent use and thus is ideally suited for use in aluminum radiators where damage due to lack of strength is a particular problem. Moreover, by standardizing upon one fillerneck assembly made according to the invention for a whole series of plastic tank, the fillerneck of the invention is ideally suited for minimizing the tooling expense required to manufacture molded plastic tanks by eliminating the most coplex formation heretofore required in each such mold for a given tank.

I claim:

1. A fillerneck for a tank on a heat exchanger comprising:

a hollow body having an axis and an interior sealing surface intermediate its ends, said sealing surface adapted to be engaged by a seal on a pressure cap and facing axially toward one end of said body;

an exterior flange on said body one end and having pressure cap retaining surfaces theroen for retaining a pressure cap on said one end with the pressure cap seal engaging said surface;

resilient fingers extending from the other end of said body and having integral, generally radially movable retaining surfaces for retaining abutment with an end of an opening in a mounting element for said fillerneck; and an exterior sealing surface on said body intermediate the ends thereof for cooperation with a seal to seal the interface of said body and the mounting element.

2. The fillerneck of claim 1 wherein said body, between said interior sealing surface and said one end, includes a vent port.

3. The fillerneck of claim 1 wherein said exterior sealing surface is an axially facing surface facing oppositely of said interior sealing surface.

4. The fillerneck of claim 3 wherein said exterior sealing surface is defined by a side of a peripheral flange extending about said body intermediate the ends thereof, said flange further carrying antirotation means for cooperation with mating antirotation means on the mounting element.

5. The fillerneck of claim 4 wherein said antirotation means comprises radially directed formations on said flange.

6. The fillerneck of claim 1 in combination with said mounting element, said mounting element comprising a hollow coupling having a first open end for receipt of said body, an opposite open end for retaining engagement with said retaining surfaces on said fingers and an interior sealing surface facing the exterior sealing surface of said body; and a seal between and in sealing engagement with said coupling interior sealing surface and said body exterior sealing surface.

7. The combination of claim 6 further including a tank, said coupling being bonded to said tank and in fluid communication with the interior thereof.

8. The combination of claim 6 further including a tank, said coupling being integrally formed with said tank to be in fluid communication with the interior thereof.

9. The fillerneck of claim 1 wherein said retaining surfaces comprise radially outwardly directed hooks on said fingers, means defining a radially inwardly directed ledge on said fingers oppositely of said hooks, and a lock ring insertable through said body for disposition on said ledges to prevent said fingers from moving radially inwardly.

10. A fillerneck assembly comprising:

an elongated, hollow body having an elongated axis, a first, relatively larger end and a second relatively smaller end;

an axially facing interior shoulder intermediate said ends and directed toward said first end;

an exterior end flange about said first end;

pressure cap retaining means on said end flange;

an exterior, axially facing sealing surface on said body and directed toward said second end;

axially elongated fingers on said second end;

radially outwardly directed hooks on said fingers;

a coupling having an open interior extending to an enlarged end for receipt of said relatively smaller end of said body, a smaller end for engagement by said hooks and an interior, intermediate sealing surface facing said exterior sealing surface; and a seal disposed between and sealingly engaging said sealing surfaces.

11. The fillerneck assembly of claim 10 wherein said coupling is integral with a heat exchanger tank.

12. The fillerneck assembly of claim 10 wherein said exterior sealing surface is defined by a peripheral flange on said body intermediate the ends thereof.

13. The fillerneck assembly of claim 10 wherein said exterior sealing surface is defined by a peripheral flange on said body intermediate the ends thereof; a plurality of slots in one of said coupling enlarged end and said flange and a plurality of projections nesting in said slots and on the other of said coupling enlarged end and said flange to prevent relative rotation between said body and said coupling.

14. The fillerneck assembly of claim 10 further including a lock ring in said body second end and blocking radially inward movement of said fingers; and means for retaining said lock ring in said body second end.

15. A fillerneck assembly operable to be used for a radiator comprising:

an elongated, hollow body having an elongated axis, a first relatively larger end and a second relatively smaller end;

an axially facing interior shoulder intermediate said ends and directed toward said first end;

an exterior end flange about said first end;

pressure cap retaining means on said end flange;

an exterior, axially facing sealing surface on said body and directed toward said second end;

axially elongated fingers on said second end;

radially outwardly directed hooks on said fingers; and a tubular port on said body in fluid communication with the interior of said body between said first end and said interior shoulder.

* * * * *